United States Patent [19]

Isozaki et al.

[11] Patent Number: 4,919,058

[45] Date of Patent: Apr. 24, 1990

[54] DOOR OPERATING MECHANISM FOR BUSINESS MACHINES

[75] Inventors: Hiromi Isozaki, Kanagawa; Masakazu Ito, Hiratsuka, both of Japan

[73] Assignee: NCR Corporation, Dayton, Ohio

[21] Appl. No.: 374,382

[22] Filed: Jun. 30, 1989

[30] Foreign Application Priority Data

Sep. 16, 1988 [JP] Japan ..... 53-230158

[51] Int. Cl.[5] ..... G07G 5/00; E06B 7/32

[52] U.S. Cl. ..... 109/24.1; 109/66; 109/73; 902/9

[58] Field of Search ..... 109/19, 24.1, 49.5, 109/66, 73; 49/344, 345, 360, 361; 902/9

[56] References Cited

U.S. PATENT DOCUMENTS 4,612,864 9/1986 Beck et al. ..... 109/49.5

4,696,239 9/1987 Trucksess ..... 109/66

4,856,437 8/1989 Trucksess ..... 109/66

*Primary Examiner*—Neill R. Wilson

*Attorney, Agent, or Firm*—Wilbert Hawk, Jr.; Albert L. Sessler, Jr.

[57] ABSTRACT

An opening in a front panel of an automated teller machine (ATM) normally permits a portion of an internal mechanism to protrude therethrough to receive customer cards or for similar purposes. When the internal mechanism of the ATM is withdrawn for servicing, the protruding portion of the mechanism is withdrawn from the opening. A vertically slidable door is provided to close said opening whenever said protruding portion is withdrawn, in order to prevent access to the interior of the ATM by unauthorized persons. The door is operated by mechanism responsive to the movement of the internal mechanism.

12 Claims, 5 Drawing Sheets

DOOR OPERATING MECHANISM FOR BUSINESS MACHINES

BACKGROUND OF THE INVENTION

In a conventional automated teller machine or the like, when paper supplies such as recording forms are to be placed within the machine for use, and when maintenance of the machine is required, such as the correction of jamming of bills or forms within the machine, a portion of the internal mechanism of the machine must be withdrawn rearwardly with respect to the external housing of the machine to enable such supply and repair (hereinafter referred to as rear maintenance) to take place. During normal operation of the machine, a part of the mechanism referred to above extends through an opening in the external housing of the machine and is accessible to a customer using the machine to enable card reading or passbook printing. As a result, when the mechanism is withdrawn, there is an opening in the external housing of the machine.

In general, the automated teller machine (ATM) or the like is disposed within a bank or other establishment in such a manner that the front part thereof faces into a room into which customers can freely enter and the rear part thereof faces into another room within the bank where rear maintenance is performed. Accordingly, when an ATM is under rear maintenance, and the opening in the external housing is therefore exposed, it may happen that a customer will put his or her card, passbook or the like into the opening in the housing, not being aware that the ATM is under rear maintenance. After the card, passbook or the like has been put through the hole, it is difficult to retrieve, due to the restricted interior space of the machine, and there is danger of damaging the card or passbook in the course of removing it. In order to avoid the situation mentioned above, a shutter or door may be provided to close the opening in the housing when the mechanism is not extending therethrough. However the rear maintenance is usually performed with the machine in a power off state, so that the shutter or door cannot be electrically driven.

One prior art arrangement for solving this problem is shown in FIG. 5, in which a shutter 74 is provided for covering an opening 54 in a machine front panel 52 when a projecting portion 60 of the machine is withdrawn to the right, as viewed in FIG. 5. The shutter 74 is rotatably mounted on a shaft 76 which is supported on a support member fixed to the inside surface of the panel 52. An element 78 is fixed to the inside surface of the panel 52 and extends into the interior of the ATM beneath the opening 54. It will be seen that even when the shutter is drawn down, space is left between the opening 54 and the shutter 74, and therefore there is a danger that the card or passbook or the like may be inserted through the space. In addition, when the machine is constructed as shown in FIG. 5, the support member 72 extends toward the inside of the machine and it is therefore necessary to rotate the shutter 74 on the shaft 76, so that the thickness of the shutter device 70 is gradually increased toward the inside of the machine. In particular, when the opening 54 is relatively large, it is necessary to make the entire shutter device 70 thicker in the depth direction. However, only a small space may be left near the opening 54 adjacent the inside surface of the panel 52, so that it sometimes may happen that a shutter of this conventional structure cannot be provided.

Another protective door mechanism which may be used in automated teller machines and similar security machines is shown in U.S. Pat. No. 4,612,864, issued Sept. 23, 1986, inventors Robert J. Beck et al.

SUMMARY OF THE INVENTION

The present invention relates to a door or shutter operating mechanism for business machines, and more particularly relates to a door or shutter operating mechanism for use to prevent the improper insertion of cards, passbooks or the like into an opening in an ATM which is made available when a part of the ATM mechanism is withdrawn for maintenance.

In accordance with one embodiment of the invention, an apparatus comprises: a mechanism having a projecting portion; a housing having an aperture therein through which the projecting portion of said mechanism may extend; a door for closing said aperture when said projecting portion of said mechanism is not extending therethrough; a pair of parallel tracks located at opposite sides of said aperture for mounting said door for linear sliding movement parallel to the adjacent surface of said housing; resilient means for urging said door to a closed position in which it covers said aperture; operating means for moving said door from closed position to open position against the influence of said resilient means; support means fixed to said housing; lever means pivotally mounted on said support means and having one end coupled to said operating means; follower means mounted on the other end of said lever means; and engaging means fixed to said mechanism and engageable with said follower means as said mechanism is moved in a first direction to a position in which said projecting portion projects through said aperture, whereby movement of said mechanism in said first direction causes said engaging means to move said lever means to cause said operating means to move said door to open position, and whereby when said mechanism is moved in a second opposite direction so that said projecting portion is withdrawn from said aperture, said engaging means is moved out of engagement with said follower means to permit said resilient means to move said door into closed position.

It is accordingly an object of the present invention to provide a door or shutter device for a wall or housing which is capable of completely closing an opening in said wall or housing and which can be provided in a narrow space.

A further object is to provide a slidably mounted door or shutter device for a wall or housing for closing an opening which is exposed when a portion of a machine which normally extends through said opening is withdrawn for servicing, the withdrawal of said machine causing said door or shutter device to close.

With these and other objects, which will become apparent from the following description, in view, the invention includes certain novel features of construction and combinations of parts, a preferred form or embodiment of which is hereinafter described with reference to the drawings which accompany and form a part of this specification.

DETAILED DESCRIPTION

Figure 1:
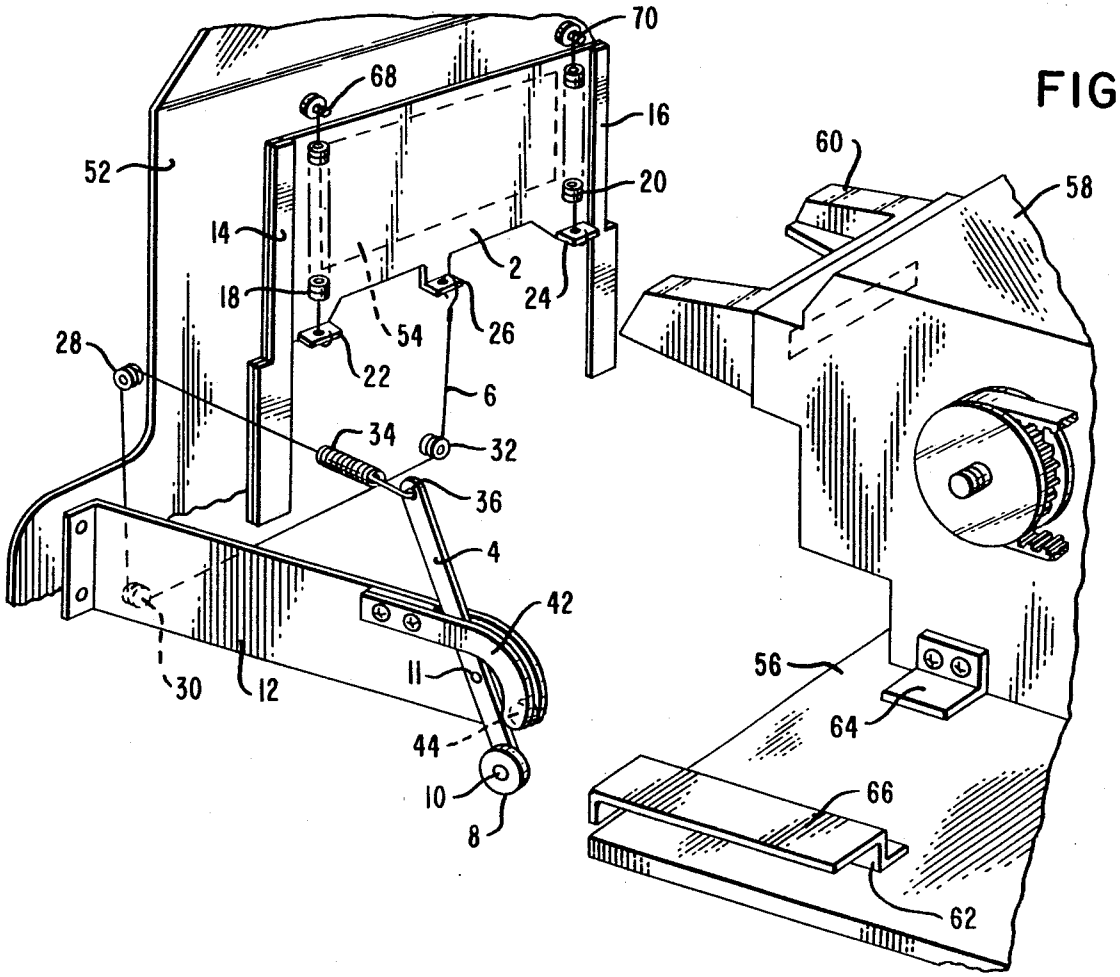
FIG. 1 is a partial perspective view, showing an exterior wall of an ATM, an internal mechanism having a projecting part which normally extends through an opening in the wall and a door in closed position covering said opening.
Figure 4:
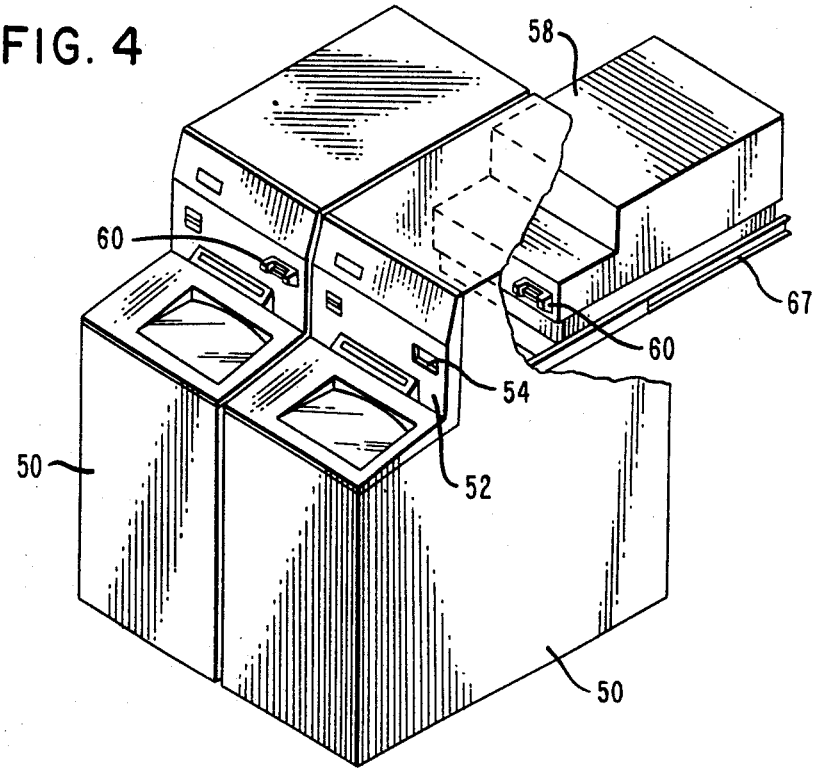
FIG. 4 is a perspective view of two adjacent ATMs, in one of which the projecting part of the internal mechanism is extending through the opening in the external housing, and in the other of which the internal mechanism has been withdrawn so that the projecting part does not extend through the opening.
Figure 5:
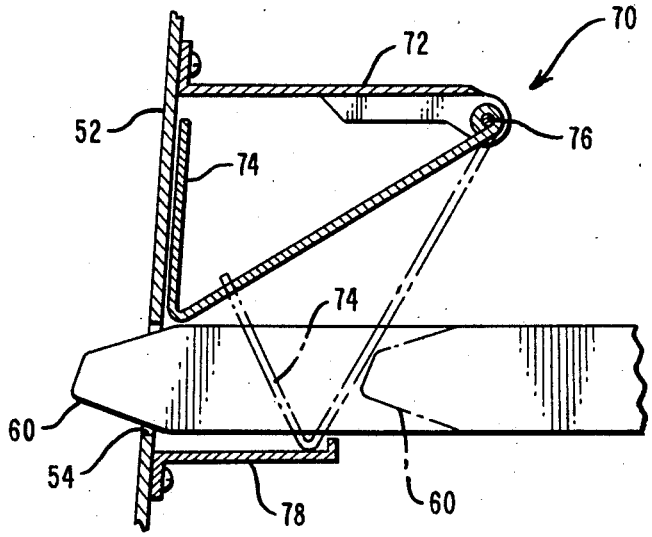
FIG. 5 PRIOR ART
FIG. 5 is a partial sectional elevation view, showing a prior art arrangement of an exterior wall, an opening therein and a door for covering said opening.

Referring to the perspective view of FIG. 1, shown there is an automated teller machine 50 viewed from the interior thereof in a condition in which a module 58 of said machine is drawn backward to the right as viewed in FIG. 1, out of operative position, and a door or shutter 2 is completely closed, thereby blocking access to an aperture 54 in a front panel 52. The shutter 2 is adapted to shield the aperture 54 in the front panel 52 during rear maintenance operations in which the module 58 is drawn to the rear of the interior space of the machine 50, as shown, for example, in the rightmost ATM of FIG. 4.

Figure 2:
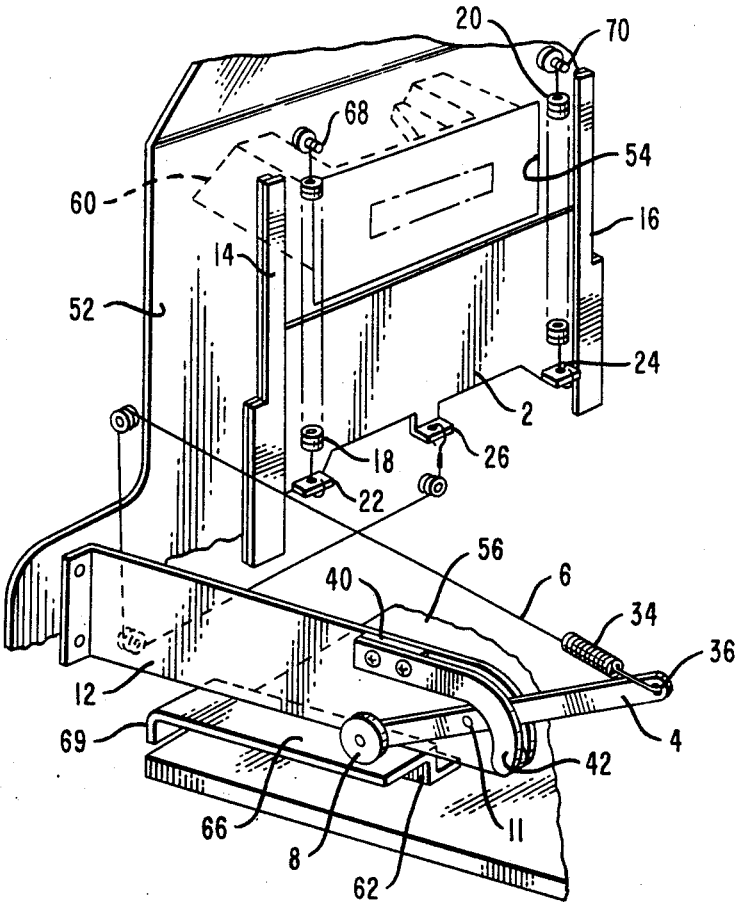
FIG. 2 is a view similar to FIG. 1, showing a portion of the wall, with the door in open position and the projecting part of the internal mechanism depicted in phantom lines extending through the opening.

In a similar perspective view of FIG. 2, the module 58 is omitted, and only an insertion guide 60 is shown in dashed lines, for convenience of description. The insertion guide 60 is projected outwardly in the manner shown by said dashed lines when the ATM 50 is in operation, and a card or the like may be inserted therein. The shutter 2 is shown in a lower position in FIG. 2, so that the aperture 54 is completely open. Two vertical guides 14 and 16 are fixed to the front panel 52, and receive the shutter 2 to constrain its movement to sliding movement in a vertical direction. A projection 22 which extends from one side of the lower edge of the shutter 2 is connected to one end of a spring 18, the other end of which is connected to a stud 68 fixed to the front panel 52. Similarly, a second projection 24 which extends from the other side of the lower edge of the shutter 2 is connected to one end of a spring 20, the other end of which is connected to a stud 70 fixed to the front panel. When the springs 18 and 20 are in their normal unstretched condition, the shutter 2 is in its uppermost position so that the opening 54 is completely closed, as shown in FIG. 1.

As shown in FIGS. 1 and 2, an arm 4 is adapted to slide the shutter 2 downward in order to expose the aperture 54. The arm 4 is pivotally supported on a pivot 11 which is provided adjacent one end of an arm supporting member 12 secured to the front panel 52. Motions of the arm are guided by an arm guide 42 which is provided on the supporting member 12. One end of a wire 6 is connected to an end 36 of the arm 4 via a spring 34. The wire extends over rollers 28, 30 and 32, and is connected at its other end to a projection which is provided at approximately the center of the lower edge of the shutter 2. Accordingly, when the arm 4 rotates in a clockwise direction as viewed in FIG. 1, the shutter 2 is pulled downwardly by the wire 6, against the force of the springs 18 and 20, and the aperture 54 is exposed. At a lower end of the arm 4, there is provided a roller 8 which is rotatable on a pivot 10.

The module 58 is fixed to a base 56 by an attaching device 64. The base 56 is slidably supported on a slider mechanism 67 (FIG. 4) together with the module 58 disposed thereon. An engagement member 62 is fixed to the base 56 and is adapted to come into engagement with the roller when the base 56 is moved to the left as viewed in FIG. 1, so as to rotate the arm 4 in a clockwise direction.

Opening and closing operations of the shutter 2 will next be described. As the base 56 moves to the left as viewed in FIG. 1 from the position shown therein, the engagement member 62 on the base comes into engagement with the roller 8 of the arm 4. Then, as the base 56 moves further to the left, the roller 8 of the arm 4 is pushed to the left, and the arm 4 therefore is caused to rotate in a clockwise direction. As a result, the shutter 2 is pulled down by the wire 6 against the force of the springs 18 and 20. As the base 56 moves further to the left, the shutter is pulled completely down, and the insertion guide 60 is projected outwardly through the aperture 54, as shown in FIG. 2.

The relationship among the engagement member 62, the arm 4 and the shutter 2, and the operation of these elements, will next be described with reference to FIGS. 3A to 3D. These figures show side views illustrating relative positions of the various parts at various times, beginning with FIG. 3A, in which the insertion guide 60 projects outside of the front panel 52, and ending with FIG. 3D, in which the module 58 is drawn out to the rear and the shutter 2 completely shields the aperture 54.

Figure 3A:
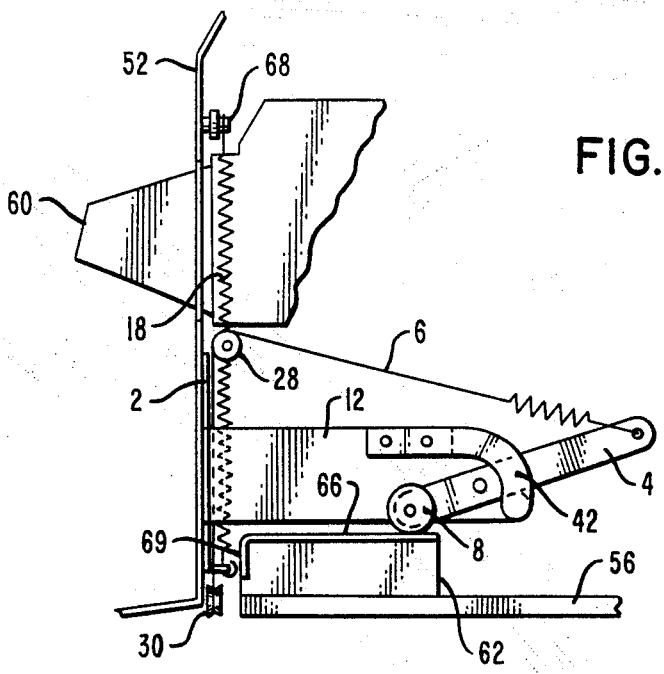
FIGS. 3A, 3B, 3C and 3D are partial elevation views, showing the external wall, the door, the internal mechanism and the door operating mechanism in various positions.
Figure 3B:
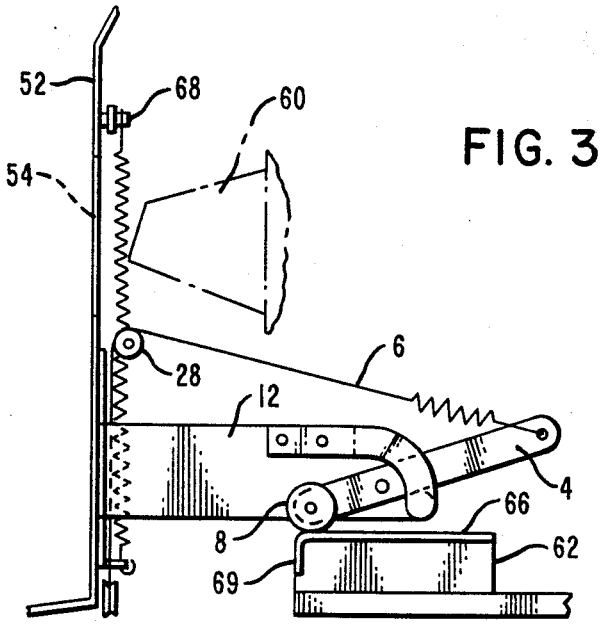
Figure 3C:
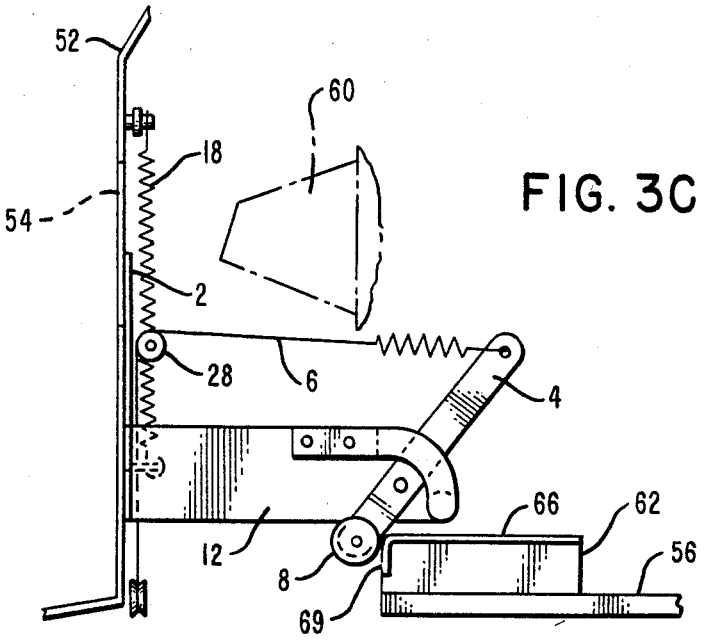
Figure 3D:
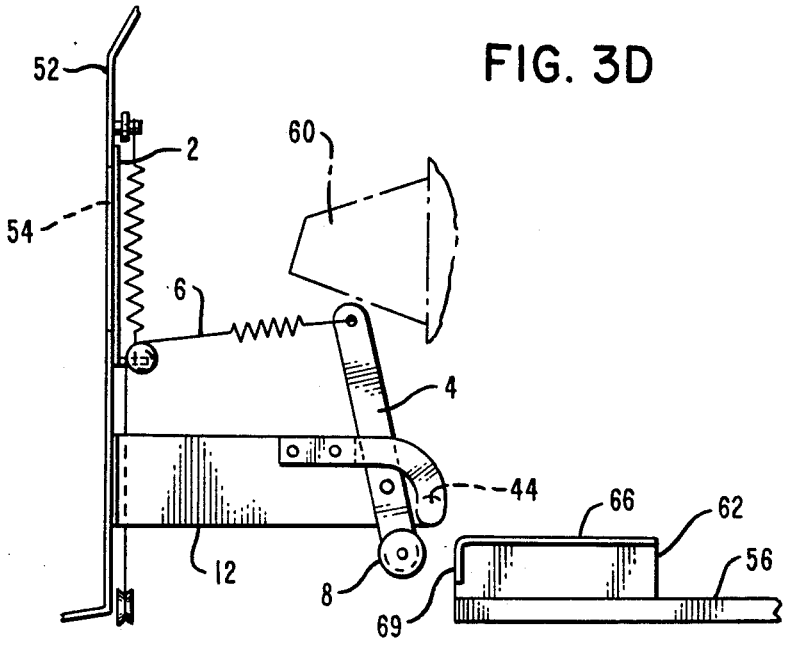

In the state shown in FIG. 3A, the shutter 2 is pulled down, the aperture 54 is completely open, and the insertion guide 60 is projected to the outside through the aperture 54. When the module 58 is drawn out to the rear for maintenance, the module 58 gradually moves to the right, and the insertion guide 60 moves to the rear together with the module 58. During the initial movement of the module 58 from the position shown in FIG. 3A to the position shown in FIG. 3B, the roller 8 of the arm 4 rolls on the upper surface 66 of the engagement member 62, so that the rotation of the arm 4 is prevented and the shutter 2 is therefore maintained in the state in which it is completely pulled down, and is inoperative to cover the aperture 54. When the module 58 moves to the position shown in FIG. 3B, the roller 8 of the arm 4 reaches an end of the engagement member 62. The insertion guide 60 is withdrawn from the aperture 54 as the module 58 is moved further to the right, and the roller 8 of the arm 4 rolls down from the upper surface 66 of the engagement member 62, as shown in FIG. 3C. The arm 4 rotates in a counterclockwise direction and the shutter 2 is pulled up by the springs 16 and 18. The rotation of the arm 4 is restricted by the engagement of the roller 8 on the arm 4 with a side 69 of the engagement member 62, so that the arm 4 gradually moves in a counterclockwise direction in accordance with the movement of the module 58. As the module 58 moves further to the right, the rotation of the arm 4 is stopped by a stopper 44 which is provided on the arm guide 42. In this state, the shutter 2 is completely pulled up and the aperture 54 is completely closed. Even if the module 58 moves slightly to the left in this state, the arm 4 will not rotate and the shutter 2 will not move, as shown in FIG. 3D.

When maintenance at the rear of the machine has been completed, the module 58 is pushed back to the left, as viewed in FIGS. 3A to 3D inclusive, into operative position, in which it is shown in FIG. 3A. When the side 69 of the engagement member 62 comes into contact with the roller 8 of the arm 4, the arm 4 is rotated in a clockwise direction by the engagement member 6 in accordance with the movement of the module, and the shutter 2 is gradually pulled down, as shown in FIG. 3C, to the position shown in FIG. 3B, in which the aperture 54 is completely open. Movement of the module 58 to the left, from the position shown in FIG. 3B to the position shown in FIG. 3A, does not result in rotation of the arm 4 because the roller 8 moves along the horizontal surface 66 of the engagement member 62. Therefore the aperture 54 is kept open, the insertion guide 60 may project completely through the aperture 54 to the outside, and the module will halt its movement after it reaches the position shown in FIG. 3A.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

What is claimed is:

1. An apparatus comprising:

a mechanism having a projecting portion;

a housing having an aperture therein through which the projecting portion of said mechanism may extend;

a door for closing said aperture when said projecting portion of said mechanism is not extending therethrough;

a pair of parallel tracks located at opposite sides of said aperture for mounting said door for linear sliding movement parallel to the adjacent surface of said housing;

resilient means for urging said door to a closed position in which it covers said aperture;

operating means for moving said door from closed position to open position against the influence of said resilient means;

support means fixed to said housing;

lever means pivotally mounted on said support means and having one end coupled to said operating means;

follower means mounted on the other end of said lever means; and engaging means fixed to said mechanism and engageable with said follower means as said mechanism is moved in a first direction to a position in which said projecting portion projects through said aperture, whereby movement of said mechanism in said first direction causes said engaging means to move said lever means to cause said operating means to move said door to open position, and whereby when said mechanism is moved in a second opposite direction so that said projecting portion is withdrawn from said aperture, said engaging means is moved out of engagement with said follower means to permit said resilient means to move said door into closed position.

2. The apparatus of claim 1, in which said operating means comprises a wire which extends from said one end of said lever means to said door, and in which said operating means also comprises a plurality of pulleys mounted on said housing for determining the path of said wire.

3. The apparatus of claim 1, in which said follower means comprises a roller rotatably mounted on the other end of said lever means.

4. The apparatus of claim 1, in which said housing has an external surface and an internal surface and in which said parallel tracks and said support means are mounted on the internal surface of said housing.

5. The apparatus of claim 1, in which said parallel tracks are mounted substantially vertically and the linear movement of said door is in a substantially vertical direction.

6. The apparatus of claim 1, in which said apparatus comprises an automated teller machine.

7. The apparatus of claim 1, in which said support means includes guide means to guide the movement of said lever means.

8. The apparatus of claim 7, in which said guide means includes stop means to limit the movement of said lever means.

9. The apparatus of claim 1, in which said engaging means includes a horizontal surface to engage said follower means to retain said door in an open position during the time that said mechanism is being moved between the position in which said projecting portion is fully projecting through said aperture and the position in which said projecting portion is fully withdrawn from said aperture.

10. The apparatus of claim 9, in which said engaging means also includes a vertical surface to engage said follower means to coact therewith to cause said door to be opened as said mechanism is being moved to the position in which said projecting portion is projecting through said aperture.

11. The apparatus of claim 1, in which said resilient means comprises a pair of springs, each spring being secured at one end to an internal surface of said housing and at its other end to one side of said door.

12. The apparatus of claim 11, in which each of said springs is secured at its other end to a projection at one side of the lower edge of said door.

* * * * *